US005960952A

United States Patent [19]

Chen

[11] Patent Number: 5,960,952

[45] Date of Patent: Oct. 5, 1999

[54] PROTECTIVE BRIEFCASE FOR NOTEBOOK COMPUTER

[75] Inventor: Mike Chien Fang Chen, Taipei Hsien, Taiwan

[73] Assignee: Racer Sporting Goods Co., Ltd., Taipei Hsien, Taiwan

[21] Appl. No.: 09/112,235

[22] Filed: Jul. 9, 1998

[30] Foreign Application Priority Data

Jun. 12, 1998 [TW] Taiwan ..... 87209384

[51] Int. Cl.[6] ..... B65D 85/00

[52] U.S. Cl. ..... 206/320; 190/125

[58] Field of Search ..... 206/320, 523, 206/576; 190/125, 127

[56] References Cited

FOREIGN PATENT DOCUMENTS 317107 10/1997 Taiwan .

*Primary Examiner*—David T. Fidei

[57] ABSTRACT

A protective briefcase for a notebook computer is provided comprising a briefcase body consisting of five side panels and a cover, said briefcase body and cover being able to be engaged to or separated from each other by using a zipper, characterized in that the five side panels of said briefcase body and said cover are comprised of an outer fabric layer, an inner fabric layer, and a laminated reinforcing layer between said outer and inner fabric layers, wherein said laminated reinforcing layer is comprised of in sequence from outside to inside a hard shock-absorbing outer layer, a flexible thin plate, and a soft shock-absorbing inner layer such that a sandwich structure is formed in order to abut against the surfaces of said notebook computer contained in said protective briefcase.

6 Claims, 4 Drawing Sheets

PROTECTIVE BRIEFCASE FOR NOTEBOOK COMPUTER

FIELD OF THE INVENTION

The present invention relates to a protective briefcase for notebook computer, and more particularly, to a protective briefcase for notebook computer which provides a shock-proof and shake-proof structure.

DESCRIPTION OF THE PRIOR ART

Recently, due to the advantages of portability and space-saving property, notebook computer are welcomed by people. However, the problem about how to protect the notebook computer and its peripheral equipment contained in the notebook computer briefcase from damage due to the impact or falling down accidentally has not been solved satisfactorily up to now. The conventional notebook computer briefcase is generally made of soft material, such as fabric or leather, which can provide only dust-proof and water-proof function, but cannot provide the function of absorbing foreign impact force. Hence, how to provide a shock-proof and shake-proof protective briefcase for a notebook computer briefcase becomes an important task.

For solving the aforesaid problem, R.O.C. (Taiwan) Utility Model Publication No. 317107 disclosed a "notebook computer briefcase", in which a hard container can be movably inserted into the inner space of said briefcase, and the inner surface of the container is provided with a protective material that can absorb an impact force, which is achieved by sandwiching a protective material for absorbing an impact force between a layered structure at two sides of the container.

However, although the conventional notebook computer briefcase mentioned above can lower the chance of damage of said notebook computer due to the collision or other impact, it can only partially, not wholly, protect said notebook computer, and provide limited shock-proof and shake-proof ability. In addition, the aforesaid R.O.C. (Taiwan) patent did not make the best choice and arrangement in shock absorbing material. Hence, when in use, the shock-proof and shake-proof function of said R.O.C. (Taiwan) patent still cannot meet the actual need.

OBJECT OF THE INVENTION

It is therefore an object of the present invention to provide a protective briefcase for notebook computer, which can provide the best protection effect in shock-proof and shake-proof ability.

It is another object of the present invention to provide a protective briefcase for notebook computer, which includes a plurality of layered structure and can receive not only a notebook computer, but also documents or other private objects which can be contained in document bags optionally provided at the sides of the briefcase such that this invention can provide a multi-purpose protective briefcase for notebook computer.

SUMMARY OF THE INVENTION

The purpose of the present invention is to solve the aforesaid drawbacks of the conventional briefcase. To achieve the objects described above and other objects, the notebook computer protective briefcase of this invention mainly comprises a briefcase body and a cover, said briefcase body and cover being connected or disconnected to each other by means of a zipper, characterized in that: the five side panels of said briefcase body and said cover are constructed by an outer fabric layer, an inner fabric layer, and a laminate plate provided between said outer and inner fabric layers, wherein said laminate plate includes in a sequence from outside to inside: a hard shock-absorbing outer layer, a flexible thin plate, and a soft shock-absorbing inner layer such that a sandwich structure is formed in order to abut against the surfaces of said notebook computer received in said protective briefcase.

Further, in the notebook computer protective briefcase of this invention, the hard shock-absorbing outer layer is made of hard polyurethane shock-absorbing foam material, and the soft shock-absorbing inner layer is made of soft polyurethane shock-absorbing foam material.

Further, in the notebook computer protective briefcase of this invention, the flexible thin plate is a flexible plastic plate, and connected to said hard shock-absorbing outer layer and soft shock-absorbing inner layer in a suitable manner (for example, by means of an adhesive agent).

According to a preferred embodiment of the present invention, each side panels of the briefcase body and the cover all are constructed by said sandwich structure in order to provide best protection for each side of said notebook computer.

In addition, in the notebook computer protective briefcase of this invention, one side of the cover is provided with a first document bag, and one side of the briefcase body opposite to said side of the cover is provided with a second document bag.

According to the preferred embodiment of the present invention, the protective briefcase can receive not only a notebook computer, but also some documents or private articles received in the document bags such that the protective briefcase possesses multiple purposes. Further, these document bags can block foreign force and provide shock-proof function as a shock-proof air bag does.

Further, in the notebook computer protective briefcase of this invention, a fastener member is provided in the briefcase body in order to fixedly receive the notebook computer therein.

According to the preferred embodiment of the present invention, the size of the space for receiving the notebook computer in the protective briefcase can be varied depending on the size of the notebook computer such that the notebook computer can be fixedly received in said space.

BRIEF DESCRIPTION OF THE DRAWINGS

These and other attributes of the present invention will become clear upon a thorough study of the following description of the preferred embodiment for carrying out the invention, particularly when reviewed in conjunction with the drawings, wherein.

DETAILED DESCRIPTION OF THE INVENTION

Please refer to FIGS. 1 to 5, preferred embodiments of the present invention will be explained in detail.

Figure 1:
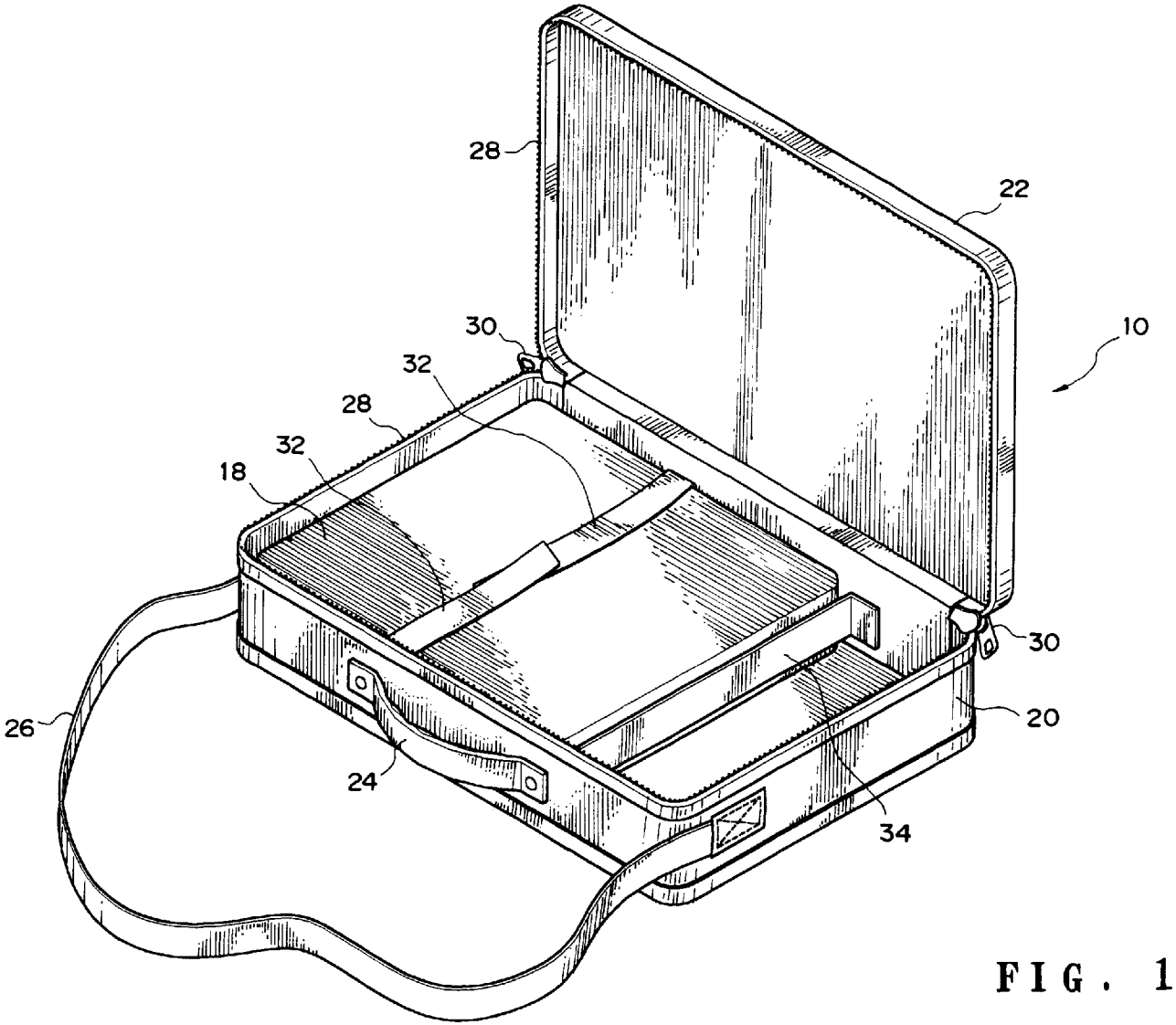
FIG. 1 is a perspective view of a notebook computer protective briefcase in accordance with the present invention, with a notebook computer disposed within said briefcase.

Embodiment 1:

FIG. 1 is a perspective view of the notebook computer protective briefcase of the present invention, with a notebook computer disposed within the briefcase. In FIG. 1, a notebook computer protective briefcase is designated by reference numeral 10, a notebook computer is designated by reference numeral 18; said protective briefcase 10 has a briefcase body 20, a cover 22, a hand grip 24, a carrying belt 26, a zipper 28 having a zipper head 30 and provided between said briefcase body 20 and said cover 22, a first fastening belt 32 and a second fastening belt 34 for the notebook computer.

The notebook computer protective briefcase 10 mainly comprises a briefcase body 20 and a cover 22, and can be closed or opened by means of a zipper 28. A notebook computer 18 is disposed in said protective briefcase 10. Said first fastening belt 32 is used to fix the wider surface of said notebook computer, and said second fastening belt 34 is used to divide the inner space of the briefcase body 20. Said first and second fastening belts 32, 34 utilize a velco tape to achieve the purpose of fastening or fixing. Thus, after said notebook computer 18 is fixed and disposed in said briefcase body 20 by means of the first and second fastening belts 32, 34, then user can close the briefcase 10 by pulling said zipper head 30 of said zipper 28, and can hand-carry said protective briefcase 10 with the hand grip 24, or, carry said protective briefcase 10 on the shoulder by using said carrying belt 26.

Figure 2:
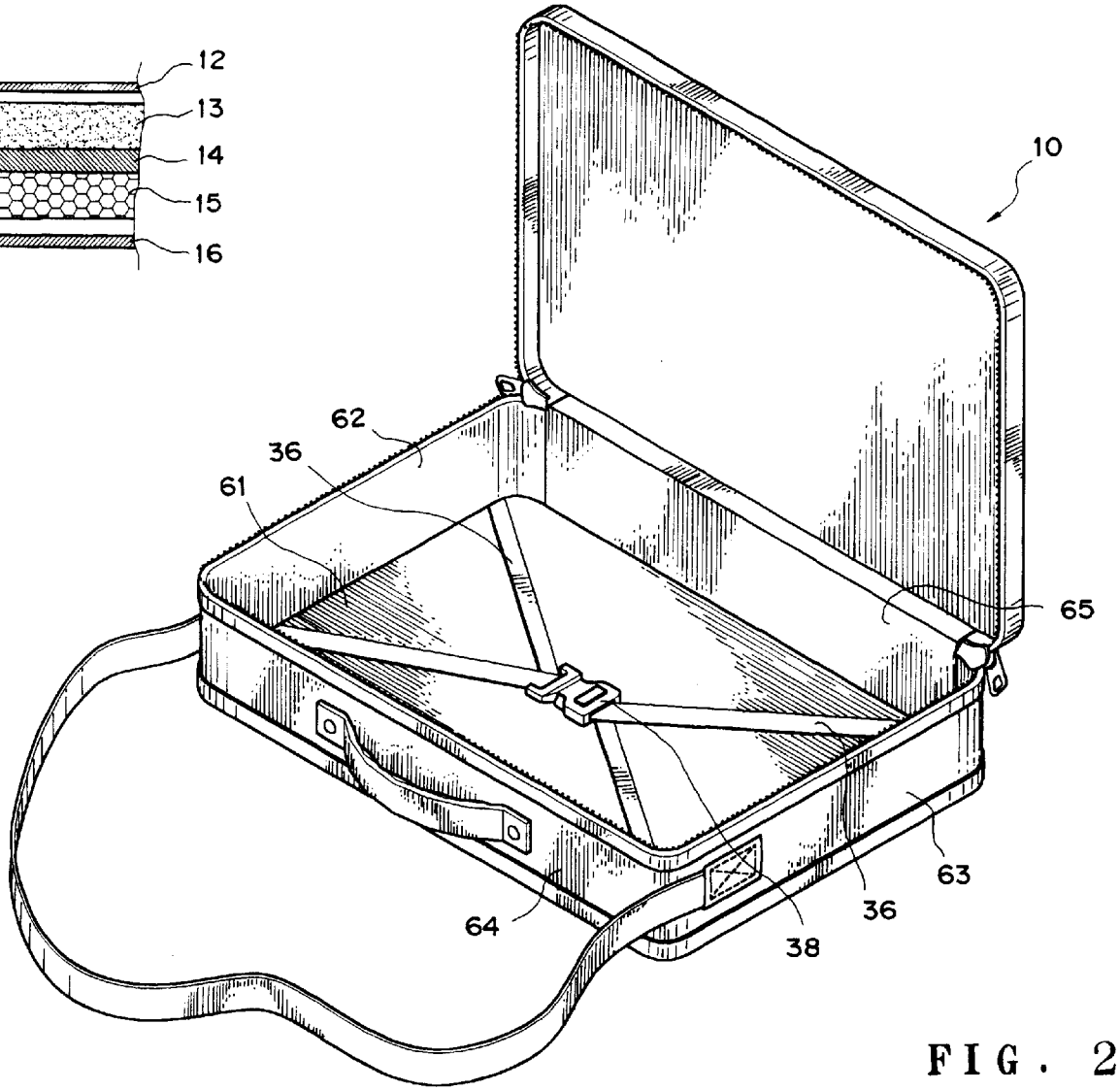
FIG. 2 is a perspective view of a notebook computer protective briefcase in accordance with the present invention, without a notebook computer disposed in said briefcase.
Figure 3:
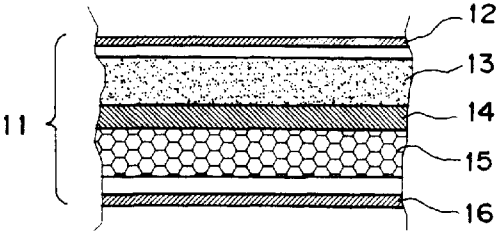
FIG. 3 is a schematic view illustrating the layered structure of the laminate plate forming the briefcase body and the cover of the notebook computer protective briefcase of the present invention.

FIG. 2 is a perspective view of the notebook computer protective briefcase of the present invention, without a notebook computer disposed within the briefcase 10. FIG. 3 is a schematic view illustrating the layered structure of the briefcase body and the cover of the notebook computer protective briefcase of the present invention. In FIG. 2, reference numeral 10 designates a notebook computer protective briefcase, 36 designates a third fastening belt, 38 designates a buckle, and 61–65 designate five side panels of said protective briefcase 10 respectively. In FIG. 3, reference numeral 11 designates a laminated plate, 12 designates an outer fabric layer; 13 designates a hard shock-absorbing outer layer; 14 designates a flexible thin plate; 15 designates a soft shock-absorbing inner layer; and 16 designates an inner fabric layer.

The notebook computer protective briefcase 10 of the present invention is characterized in that the five side panels 61–65 of said briefcase body 20 and said cover 22 all are constructed by an outer fabric layer 12, an inner fabric layer 16, and a laminate plate 11 between said outer and inner fabric layers 12, 16. Said laminate plate 11 includes in a sequence from outside to inside: a hard shock-absorbing outer layer 13, a flexible thin plate 14, and a soft shock-absorbing inner layer 15, and thereby a sandwich structure (layered structure) is formed; said sandwich structure can abut against the surfaces of said notebook computer received in the protective briefcase 10, and absorb the shock in order to protect said notebook computer 18 from damage.

Said hard shock-absorbing outer layer 13 is made of hard polyurethane shock-absorbing foam material, and the soft shock-absorbing inner layer 15 is made of soft polyurethane shock-absorbing foam material. The thickness of said flexible thin plate 14 can be varied if desired, and said thickness is preferably 0.05 cm. Said flexible thin plate 14 is made of flexible material, for example, a flexible plastic plate. Said hard shock-absorbing outer layer 13, flexible thin plate 14 and soft shock-absorbing inner layer 15 of said laminate plate 11 are connected together in a suitable manner (for example, by mean of an adhesive agent). In addition, by means of the elasticity of the third fastening belt 36 and the buckles 38, said notebook computer can be fixed in position.

According to the preferred embodiment of the present invention, when the protective briefcase 10 with a notebook computer 18 disposed therein is impacted by a foreign force, said hard shock-absorbing outer layer 13 firstly distributes said impact force imposed on a point to a larger area, and then, through the good ability of shock-absorbing of said soft shock-absorbing inner layer 15, the impact force can be offset, and by means of the soft shock-absorbing inner layer 15 enclosing said notebook computer 18, the notebook computer 18 can be prevented from shaking due to the foreign force. In addition, the polyurethane shock-absorbing foam material used in the present invention still can be restored to its original condition after compressed by a foreign force. Hence, after a foreign compression force imposed on said protective briefcase 10 is released, the polyurethane shock-absorbing foam material can restore to its original shape automatically in order to prevent said protective briefcase 10 from deformation. In other word, the laminate plate 11 of the present invention have the material characteristic of both hard and soft polyurethane shock-absorbing foam material, and thus it can resist the impact of foreign force to a great extent. Further, the middle flexible thin plate 14 has the effect of maintaining shape and increasing mechanical strength.

Embodiment 2

Figure 4:
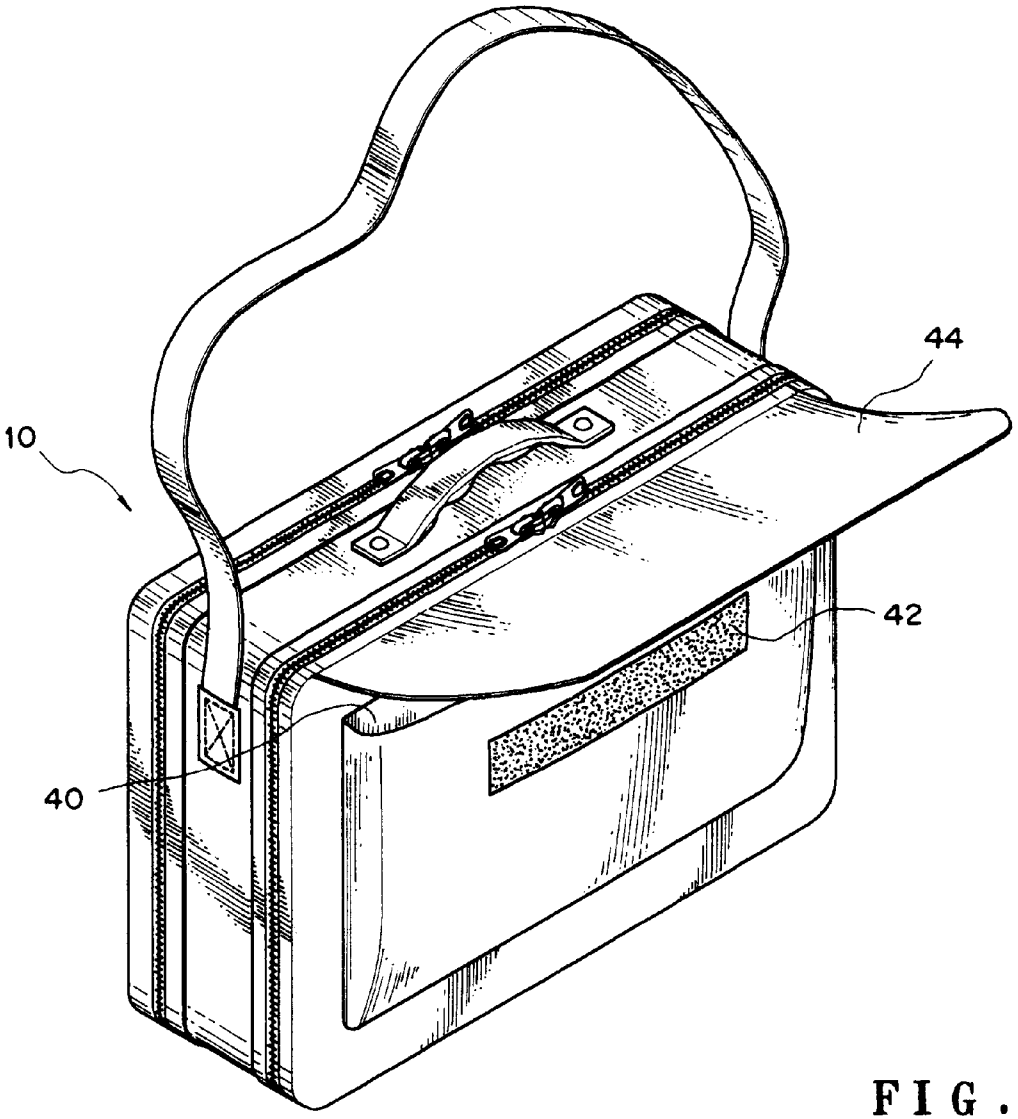
FIG. 4 is a perspective view of a notebook computer protective briefcase in accordance with the present invention, in which one side of said protective briefcase is provided with a first document bag.
Figure 5:
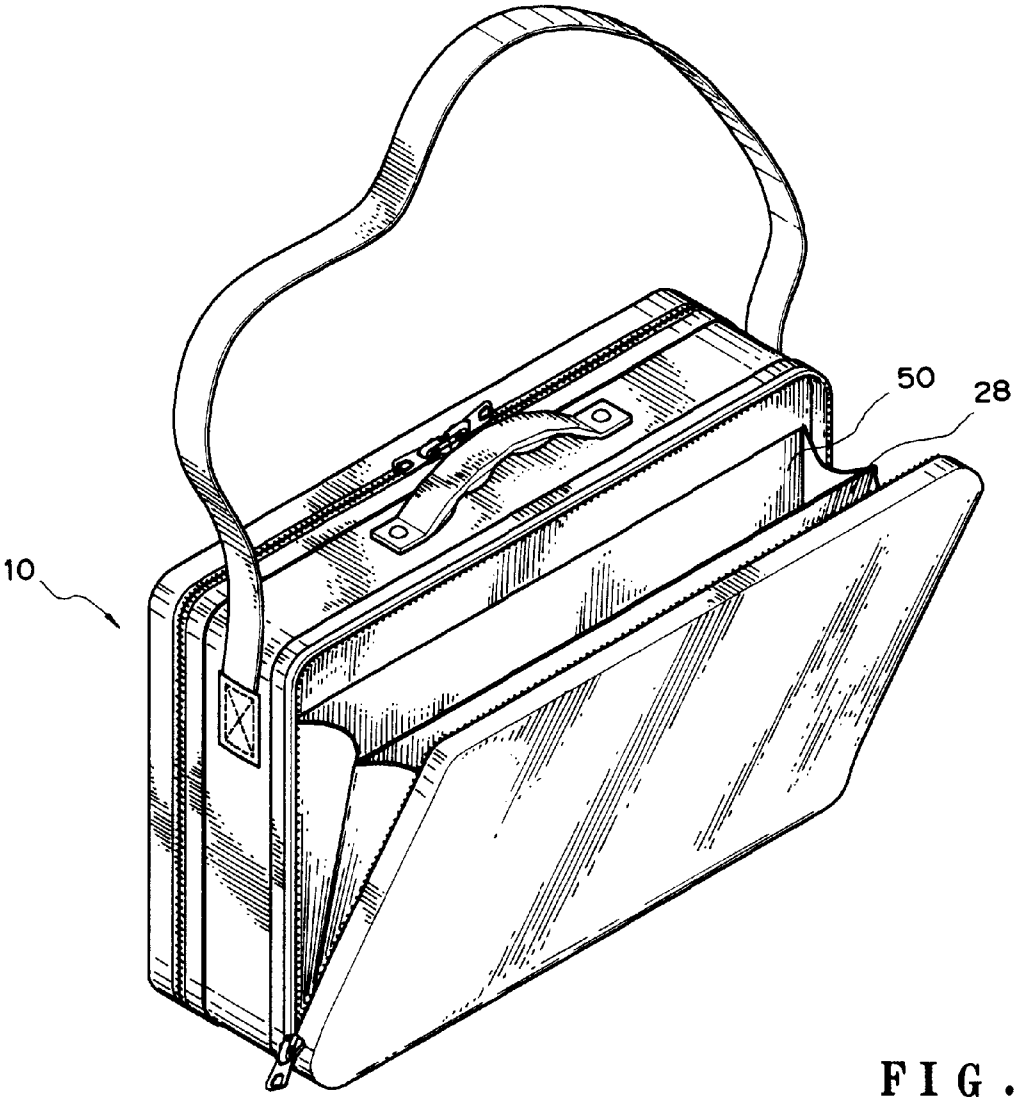
FIG. 5 is a perspective view of a notebook computer protective briefcase in accordance with the present invention, in which, the other side of said protective briefcase is provided with a second document bag.

FIG. 4 is a perspective view of a notebook computer protective briefcase in accordance with the present invention, in which one side of said protective briefcase is provided with a first document bag. FIG. 5 is a perspective view of a notebook computer protective briefcase in accordance with the present invention, in which the other side of said protective briefcase is provided with a second document bag. In FIG. 4, a notebook computer protective briefcase is generally designated by reference numeral 10; a first document bag is designated by reference numeral 40, a loop portion of a velco tape provided on said first document bag 40 is designated by reference numeral 42, and a upper lid of said first document bag 40 is designated by reference numeral 44. In FIG. 5, a notebook computer protective briefcase is designated by reference numeral 10, a zipper is designated by reference numeral 28, a second document bag is designated by reference numeral 50.

In this preferred embodiment, since one side of said cover 22 is provided with a first document bag 40, and/or one side of said briefcase body 20 opposite to said side of said cover 22 is provided with a second document bag 50 such that the protective briefcase 10 can receive not only a notebook computer 18, but also notebook computer peripheral equipment, documents, even private articles like clothes, etc., in said first and second document bags 40, 50, and thus the protective briefcase 10 is more convenience for users when they on business vacation. Said first document bag 40 can be closed or opened by means of the engagement between said upper lid 44 and the loop portion 42, and said second document bag 50 can be closed or opened by means of the zipper 28. In addition, since said first and second document bags 40, 50 are provided at both sides of said protective briefcase 10, the notebook computer 18 disposed in said protective briefcase 10 can also utilize said first and second document bags 40, 50 to block the foreign force and provide shock-proof function as a shock-proof air bag does.

According to this preferred embodiment, since the periphery of the notebook computer protective briefcase 10 is provided with a laminate plate 11 which comprises a hard shock-absorbing outer layer 13, a flexible thin plate 14, and a soft shock-absorbing inner layer 15, the chance of damage of the notebook computer due to the impact will be significantly lowered. According to experiment conducted by the inventor of the present invention, when dropping the notebook computer protective briefcase 10 from the height of 1.5 m, although there is a shock or shake occurred, the notebook computer have no damage, and simultaneously possesses the flexibility of the soft notebook computer protective briefcase.

In addition, according to the preferred embodiment of the present invention, the inner space of said notebook computer protective briefcase 10 can be modified by using the fastening belts, and users can also put documents or private articles into the additional document bags if desired. Hence, the present invention can provide a multi-purpose notebook computer protective briefcase 10 for users.

The present invention is not limited by the forgoing description of the embodiments, the invention may be embodied in other specific forms without departing from the spirit or essential characteristic of the appended claims.

What is claimed is:

1. A protective briefcase for notebook computer, comprising a briefcase body consisting of five side panels and a cover, said briefcase body and cover being able to be engaged to or separated from each other by using a zipper, said five side panels of said briefcase body and said cover being comprised of an outer fabric layer, an inner fabric layer, and a laminated reinforcing layer between said outer and inner fabric layers, wherein said laminated reinforcing layer includes in a sequence from outside to inside a hard shock-absorbing outer layer, a flexible thin plate, and a soft shock-absorbing inner layer such that a sandwich structure is formed in order to abut against the surfaces of said notebook computer contained in said protective briefcase.

2. A protective briefcase for notebook computer as claimed in claim 1, wherein said hard shock-absorbing outer layer is made of hard polyurethane shock-absorbing foam material, and said soft shock-absorbing inner layer is made of soft polyurethane shock-absorbing foam material.

3. A protective briefcase for notebook computer as claimed in claim 1, wherein said flexible thin plate is a flexible plastic plate.

4. A protective briefcase for notebook computer as claimed in claim 1, wherein said hard shock-absorbing outer layer, said flexible thin plate, and said soft shock-absorbing inner layer of said laminate plate are connected together by means of an adhesive agent.

5. A protective briefcase for notebook computer as claimed in claim 1, wherein said cover is provided with a first document bag at one side thereof, and one side of said briefcase body opposite to said side of said cover is provided with a second document bag.

6. A protective briefcase for notebook computer as claimed in claim 1, wherein said briefcase body includes a fastener member in order to hold and fix said notebook computer in said protective briefcase.

* * * * *